United States Patent [19]

Perry

[11] 3,938,250

[45] Feb. 17, 1976

[54] DISPOSABLE BLADE UNIT

[75] Inventor: Roger L. Perry, Lynnfield Center, Mass.

[73] Assignee: The Gillette Company, Boston, Mass.

[22] Filed: May 15, 1974

[21] Appl. No.: 470,224

[52] U.S. Cl. ..... 30/346.57; 30/50
[51] Int. Cl.[2] ..... B26B 21/22
[58] Field of Search ..... 30/50, 346.57, 346.58, 30/346.59

[56] References Cited

UNITED STATES PATENTS

| | | | |
|---|---|---|---|
| 1,975,757 | 10/1934 | Gray | 30/346.58 X |
| 2,044,698 | 6/1936 | John | 30/346.59 X |
| 3,786,563 | 1/1974 | Dorion | 30/50 |
| 3,842,499 | 10/1974 | Dorion | 30/50 |
| 3,861,040 | 1/1975 | Dorion | 30/50 X |
| 3,863,340 | 2/1975 | Perry | 30/50 X |

FOREIGN PATENTS OR APPLICATIONS

| | | | |
|---|---|---|---|
| 219,988 | 10/1942 | Switzerland | 30/346.57 |
| 973,077 | 9/1950 | France | 30/50 |

*Primary Examiner*—Al Lawrence Smith
*Assistant Examiner*—Gary L. Smith

[57] ABSTRACT

A disposable blade unit comprises two sets of cutting edges and a thin, transversely flexible web connecting the two sets of cutting edges. Each set of cutting edges includes a leading cutting edge and a following cutting edge, the cutting edges being permanently secured together in fixed geometrical relation. Each set of cutting edges also includes a support surface adapted to be received on the platform of a safety razor frame. The leading edge of each set is disposed below the plane of the support surface and the following edge of each set is disposed above the plane of that support surface.

2 Claims, 6 Drawing Figures

FIG 1
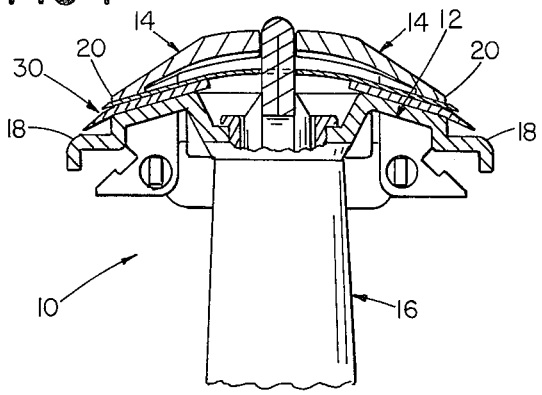
FIG 2
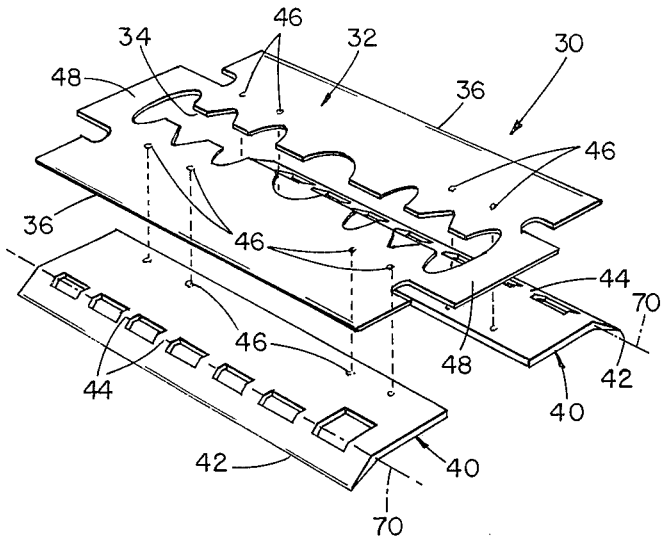
FIG 3
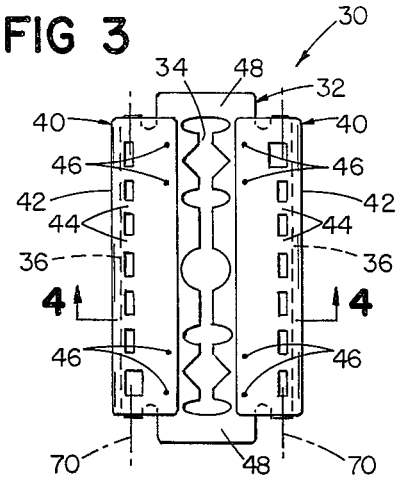
FIG 4
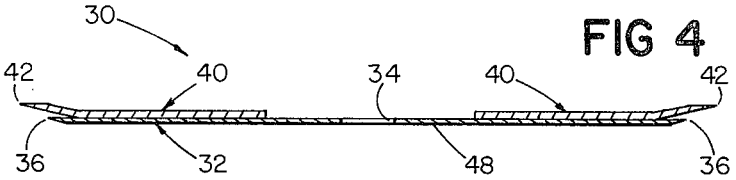
FIG 5
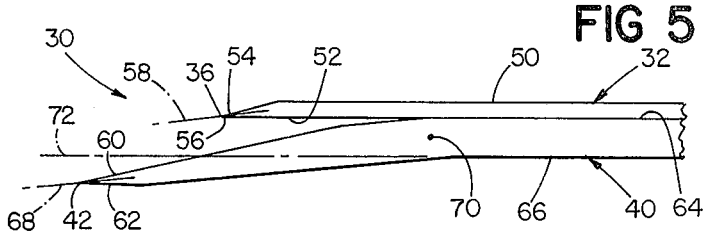
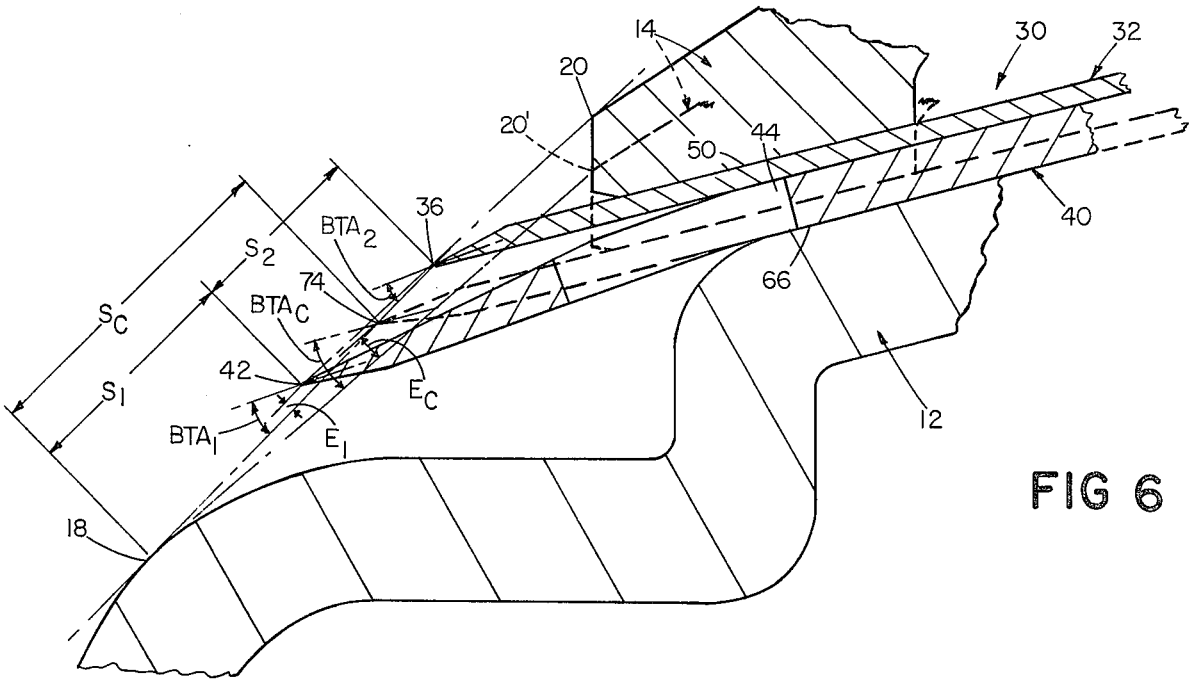
FIG 6

DISPOSABLE BLADE UNIT

SUMMARY OF INVENTION

This invention relates to shaving systems and more particularly to improved disposable blade units of the tandem edge type.

It is known that a tandem cutting edge shaving system can provide superior shaving characteristics. Such a shaving system includes at least two cutting edges disposed parallel to one another in spaced relation to provide leading and following cutting edges so that both cutting edges are successively active with respect to the hair elements being cut during a single shaving stroke.

The relationships of components of a tandem edge blade unit are conveniently discussed in terms of certain parameters defined as follows. The blade tangent angle (BTA) of an edge is the angle between the plane bisecting the two planes or facets defining the edge and the plane through the edge and the skin engaging surface next forward of the edge. The portion of the bisecting plane external to the material of the edge and the portion of the tangent plane forward of the edge are conventionally used in defining the angle so that a blade tangent angle less than 90° is obtained in any practical shaving geometry. The span (S) of an edge is the distance from the edge to the next forward skin engaging surface measured in the plane through the edge and tangent to the next forward skin engaging surface. The exposure (E) of an edge is the distance of the edge from a plane defined by the next forward and the next rearward skin engaging surfaces. The exposure may be positive or negative and is reckoned positive when the edge lies in the skinward side of the doubly tangent plane. In a tandem edge blade unit having, for example, two edges, the leading edge itself is considered to be the skin engaging surface next forward of the following edge, so that its position will in part determine the blade tangent angle and the exposure of the following edge. Further, the following edge itself is considered to be the next rearward skin engaging surface of the leading edge, so that its position will in part determine the exposure of the leading edge.

It will therefore be readily appreciated that the several geometric parameters discussed above are interrelated, and in devising a tandem edge blade unit it is necessary to consider the interrelationship in order to advantageously combine the optimum values of the several parameters. It has been found advantageous in a tandem edge shaving system to establish a span in the range of 0.03 inch to 0.08 inch; an exposure of each cutting edge in a range of −0.002 inch to +0.004 inch; and a blade tangent angle in the range 20° to 32°, each blade tangent angle preferably being in the range of about 22°–28°.

It has been proposed to provide such a tandem acting cutting edge shaving system with a disposable blade unit that is inserted into a conventional safety razor frame designed to receive conventional disposable double edge blades. However, providing a commercially acceptable, replaceable, tandem edge blade unit for use with a conventional double edge razor frame involves a number of problems. These problems relate primarily to the facts that the guard and cap structures, together with the blade between them, define the shaving geometry (blade tangent angle (BTA), span and exposure) of the shaving system and the guard and cap structures of such conventional razor frames cannot be changed, except for certain spacing adjustments in adjustable razors. A particular problem arises in connection with razor frames of the type in which the cap structure is constrained to movement solely in substantially vertical direction toward and away from the platform. As the cap and guard structures must be spaced further apart to accommodate a blade unit of the tandem edge type, this increased spacing tends to result in an increased blade tangent angle configuration rather than the reduced blade tangent angle configuration that is a characteristic of the geometry of the preferred tandem edge shaving system. Proposed disposable blade units for tandem acting cutting edge shaving systems have generally positioned the leading edge of the blade unit at substantially the same point and the same plane in a conventional single edge system with the additional components offset upwardly in stack relation. Examples of such systems are disclosed in copending applications Ser. No. 381,768; Ser. No. 287,513 now Pat. No. 3,833,340; and Ser. No. 287,335 now Pat. No. 3,861,040.

It is an object of this invention to provide a novel and improved blade unit of the tandem edge type for use with conventional razor frames.

Another object of the invention is to provide a novel and improved blade unit having a cutting edge geometry that cooperates with the cap and guard portions of a conventional double edge razor frame to establish particular geometric relationships within acceptable ranges.

Another object of the invention is to provide a novel and improved blade unit whose design is such as to allow simple and economic manufacture.

In accordance with the invention there is provided a disposable blade unit comprising a set of cutting edges that includes a leading cutting edge and a following cutting edge. The cutting edges are permanently secured together in fixed geometrical relation. The set of cutting edges also includes a planar support surface. The leadng edge of the set is disposed below the plane of the support surface and the following edge of the set is disposed above the plane of that support surface.

A variety of blade combinations and edge geometries may be employed in blade units in accordance with the invention including, for example a spacer strip of plastic or metal may be used. The blade components are permanently secured by any suitable means as by welding or water-resistant adhesive. While the blade units of the present invention are illustrated and described as being for use in conventional razor frames of the double edge type it will be appreciated that aspects of the invention are applicable to and suitable for use in conventional razor frames of the single edge type.

In a particular embodiment, the disposable blade unit comprises a thin, transversely flexible base blade which is apertured along its longitudinal center line and has its two longitudinal edges sharpened to cutting edges. A pair of supplemental blades, each having a length substantially equal to that of the base blade, a width of less than half that of the base blade and one longitudinal sharpened edge, are permanently affixed to the base blade with each supplemental cutting edge positioned parallel to and outwardly of the adjacent cutting edge of the base blade. Each supplemental blade provides a planar blade unit support surface and its cutting edge is offset below the plane of that support surface. It will be apparent that the supplemental blades could be positioned with their cutting edges inwardly of the edges of the base blade in a modified blade unit.

The bisector of the facets defining each cutting edge preferably is disposed at a downwardly inclined angle of at least 1° to the plane of the support surface. In the particular embodiment, the base blade is narrower than a conventional double edged blade and each edge bisector is inclined downwardly about 7° towards its adjacent supplemental blade; and the two supplemental blades are positioned so that their edges are spaced apart a distance greater than that of a conventional blade. Each supplemental blade has a longitudinal bend that shifts its cutting edge downwardly and inclines its bisector downwardly at an angle of about 5°, the bisector of the edge facets being parallel to the blade body in the absence of the bend. The blade unit provides a shaving geometry in a conventional razor with the distance (span) between the tandem edges in the range of 0.03 to 0.08 inch and a blade tangent angle of the following edge at a value in the range of 20° to 32°. Preferably, the blade tangent angle of each edge is in the range of 22°–28°; and the exposure of each edge is in the range of −0.002 to +0.003 inch.

The resulting blade unit when inserted in a conventional razor frame in which the cap movement relative to the platform is constrained to the vertical direction provides a desirable shaving geometry that accommodates the increased spacing between the cap and guard due to the increased thickness of the blade unit with the leading edge positioned below the normal position of the single edge blade in the razor and the following edge positioned above that normal blade position so that blade tangent angles smaller than the blade tangent angle with a conventional blade are obtained. The invention provides a disposable, tandem edge blade unit for incorporation in a conventional razor frame of the general character described above and gives highly satisfactory shaving results.

Other objects, features and advantages of the invention will be seen as the following description of a particular embodiment progresses, in conjunction with the drawing, in which:

FIG. 1 is a transverse sectional diagrammatic view of a typical commercially available safety razor frame designed for use with conventional double edge razor blades, fitted with a tandem edge blade unit in accordance with the invention;

FIG. 2 is an exploded perspective view of components of a blade unit in accordance with the invention;

FIG. 3 is a bottom plan view of the assembled blade unit;

FIG. 4 is a sectional view taken along the line 4—4 of FIG. 3;

FIG. 5 is an enlarged view showing details of a set of sharpened edges of the blade unit; and FIG. 6 is an enlarged view showing the blade unit geometry in a conventional razor frame.

DESCRIPTION OF PARTICULAR EMBODIMENT

The safety razor frame 10 shown in FIG. 1 is of a commercially available type designed for use with conventional double edge disposable blades having a single cutting edge formed in each of the two longitudinal edges of the blade. The razor includes a base or platform 12 on which the blade rests, a cap 14 that is movable vertically down toward the platform 12 for clamping the blade against the platform, and a handle 16. Razor frames of this type has a longitudinally extending guard 18 on either side of the platform and the leading edge 20 of the cap 14 defines a cooperating surface that contributes to the definition of shaving geometry. A plural edge blade unit 30 according to the invention is clamped between the platform 12 and cap 14.

Additional details of the improved disposable blade unit 30 are shown in FIGS. 2–4. That blade unit comprises a flexible steel base blade 32 that has an aperture 34 of conventional design extending longitudinally along its center with a flexible web 48 at either end of aperture 34. A sharpened shaving edge 36 is formed at either longitudinal edge. The blade is about 0.004 inch in thickness and about 0.85 inch in width. Secured to base blade 30 on either side of longitudinal aperture 34 are two identical supplemental steel blade members 40, each of which is in the form of a plate about 1.5 inch long, about 0.3 inch wide, and about 0.01 inch thick. Each blade 40 has a sharpened edge 42. A series of webs 44 each about 0.06 inch long and spaced apart about 0.12 inch extend along the transverse length of the blade about 0.05 inch from edge 42 and the edge portion is bent downwardly relative to the plane of the main body of the blade 40 along axis 70 that extends through webs 44. The base blade 32 and supplemental blades 40 are permanently affixed to each other as by spot welds 46 to form plural edge blade unit 30 that has parallel edges 42 spaced about 0.9 inch apart and flexible central webs 48.

Details of the sharpened edges and their relationship to one another may be seen with reference to FIG. 5. The body of base blade 32 has parallel planar faces 50, 52 and each sharpened edge 36 is positioned asymmetrically with respect to faces 50 and 52, edge 36 being closer to face 52. Edge 36 is defined by facets 54, 56 of such configuration such that the bisector 58 of the edge 36 is disposed at an angle of about 7° to the plane of the blade as defined by faces 50 and 52.

Sharpened edge 42 of each supplemental blade 40 is also formed asymmetrically with respect to the body of the blade, that edge being defined by facets 60, 62. In the blade forming process a flat plate having planar faces 64, 66 is punched to form the series of webs 44. Edge 42 is then formed so that the bisector 68 is parallel to faces 64, 66 with edge 42 offset about 0.003 inch from the median plane between faces 64 and 66 so that it is about 0.002 inch from face 66. After edge 42 is formed, the blade is bent along the longitudinal line generally indicated at 70 that extends through the webs 44 to further offset the blade edge 42 from the median plane, that bend in this embodiment being at an angle of about 5° to position edge 42 about 0.007 inch beneath the plane 72 in which face 66 lies. If desirable, the bend may be formed in the blade prior to one or more of the sharpening steps. The blades are then bonded, as by welding to provide the edge relationship shown in FIG. 5. In that relationship, edge 42 is about 0.007 inch below plane 72 and edge 36 is about 0.01 inch above plane 72.

An enlarged view of the shaving geometry that is achieved with the blade unit of FIGS. 2–5 positioned in a conventional razor frame is indicated in FIG. 6. Blade unit 30 is clamped by vertical motion of cap 14 towards platform 12 so that planar support faces 66 are firmly seated on platform 12. The geometry of a typical razor frame for conventional double edge blades (the blade edge being located at point 74) provides a blade tangent angle ($BTA_c$) of about 29½°, an exposure ($E_c$) of about 0.004 inch, and a span ($S_c$) of about 0.06 inch. It will be seen that in accommodating blade unit 30, cap edge 20 is offset about 0.01 inch above its location 20' with a conventional double edge blade. The leading edge 42 of blade unit 30 is positioned forwardly of and below point 74 and the trailing edge 36 is disposed above and rearwardly of point 74. A system of the type shown in FIG. 6 provides a blade tangent angle ($BTA_1$) for edge 42 of 25°–28° and a blade tangent angle ($BTA_2$) for edge 36 of 22°–25°; an exposure ($E_1$) for edge 42 of about 0.0015 inch, and about zero (0.000 inch) exposure ($E_2$) for edge 36; and a span ($S_1$) for edge 42 of about 0.06 inch, and a span ($S_2$) for edge 36 of about 0.035 inch.

This plural edge blade unit as received into a double edge razor frame of conventional commercial type provides excellent shaving results.

While a particular embodiment of the invention has been shown and described, modifications thereof will be apparent to those skilled in the art and therefore it is not intended that the invention be limited to the disclosed embodiment or to details thereof and departures may be made therefrom within the spirit and scope of the invention.

What is claimed is:

1. A disposable blade unit for a safety razor comprising a thin, transversely flexible base blade which is apertured along its longitudinal center line and has two parallel, longitudinal edges that are sharpened to cutting edges, the overall width of the blade between its cutting edges being from 0.8 to 1.0 inch, a pair of supplemental blades, each said supplemental blade having a planar body portion permanently secured in contact with a planar portion of said base blade, each supplemental blade having a length substantially equal to that of said base blade and a width less than half that of said base blade, each said supplemental blade having a longitudinal edge that is sharpened to a cutting edge positioned parallel to and offset from the adjacent longitudinal edge of said base blade, the edge of each said supplemental blade and the adjacent edge of said base blade defining a set of tandem blade edges, the cutting edges of each said set being spaced apart a distance in the range of 0.03 to 0.08 inch, and lower surfaces of said blade unit defining planar support surfaces, one planar support surface being associated with each set of tandem blade edges, one sharpened edge of each set of tandem blade edges being disposed below its associated planar support surface and the other sharpened edge of each set of tandem blade edges being disposed above its associated planar support surface, the blade tangent angle of each said other edge being in the range of 22°–28°, and the bisector of the angle between the facet surfaces that defines each sharpened edge being disposed at a downwardly inclined angle of at least 1° to its associated planar support surface.

2. The blade unit as claimed in claim 1 wherein each said one edge is disposed 0.004 to 0.012 inch below the plane of its associated support surface, each said other edge is disposed 0.004 to 0.012 inch above its associated planar support surface, and each said bisector is disposed at a downwardly inclined angle in the range of 4°–8° to its associated planar support surface.

* * * * *